US012808570B2

(12) United States Patent
Loutz et al.

(10) Patent No.: US 12,808,570 B2
(45) Date of Patent: Nov. 24, 2026

(54) MAGNETIC AIR VENT DEFLECTOR

(71) Applicant: YOBL Digital Marketing Inc., Madison, WI (US)

(72) Inventors: Omri Loutz, Ashkelon (IL); Yuval Bar-Hai, Ashkelon (IL)

(73) Assignee: YOBL DIGITAL MARKETING INC., Madison, WI (US)

( * ) Notice: Subject to any disclaimer, the term of this patent is extended or adjusted under 35 U.S.C. 154(b) by 0 days.

(21) Appl. No.: 19/648,025

(22) Filed: Apr. 15, 2026

(65) Prior Publication Data

US 2026/0251341 A1 Aug. 27, 2026

Related U.S. Application Data

(63) Continuation of application No. 19/304,959, filed on Aug. 20, 2025, now Pat. No. 12,631,365, which is a continuation of application No. 29/901,805, filed on Sep. 6, 2023, now abandoned.

(51) Int. Cl.
*F24F 13/08* (2006.01)

(52) U.S. Cl.
CPC ..... *F24F 13/081* (2013.01)

(58) Field of Classification Search
None
See application file for complete search history.

(56) References Cited

U.S. PATENT DOCUMENTS 11,703,250 B1 7/2023 Mosiman et al.
12,000,616 B1 6/2024 Mosiman et al.

*Primary Examiner* — Allen R. B. Schult
(74) *Attorney, Agent, or Firm* — SLEMAN & LUND LLP

(57) ABSTRACT

An air vent deflector includes a first portion including a first sidewall and a first curved backwall, a second portion including a second sidewall and a second curved backwall, the first portion and second portion being translatable relative to one another, and a plurality of magnets disposed on the first portion and the second portion.

19 Claims, 18 Drawing Sheets

MAGNETIC AIR VENT DEFLECTOR

CROSS-REFERENCE TO RELATED APPLICATIONS

This application is a continuation of U.S. Ser. No. 19/304,959, filed Aug. 20, 2025, which is a continuation of U.S. Design Patent Application No. Ser. No. 29/901,805, filed on Sep. 6, 2023, entitled "Magnetic Air Vent Deflector," which is incorporated herein by reference in its entirety.

FIELD OF THE DISCLOSURE

The present disclosure relates to airflow control devices, and more particularly to a magnetic air vent deflector that can be removably attached to an air vent.

BACKGROUND OF THE DISCLOSURE

Air vents in heating, ventilation, and air conditioning (HVAC) systems distribute conditioned air into a room through an outlet grille. In many situations, a user may wish to block, redirect, or partially restrict the airflow from a vent to improve comfort, energy efficiency, or airflow distribution. Existing deflectors often require permanent mounting hardware or are cumbersome to install and remove. There exists a need for an air vent deflector that can be easily installed and removed without tools, is held securely in place during use.

SUMMARY OF THE DISCLOSURE

An air vent deflector includes a first portion including a first sidewall and a first curved backwall, a second portion including a second sidewall and a second curved backwall, the first portion and second portion being translatable relative to one another, and a plurality of magnets disposed on the first portion and the second portion, the first portion including a first magnet and a second magnet disposed on the first sidewall and spaced from one another, the second portion including a third magnet and a fourth magnet disposed on a coupling edge of the second curved backwall of the second portion and spaced from one another at opposite ends of the second portion, and the second portion further including a fifth magnet disposed on the second sidewall at a location opposite the first magnet on the first sidewall.

DETAILED DESCRIPTION

Figure 1:
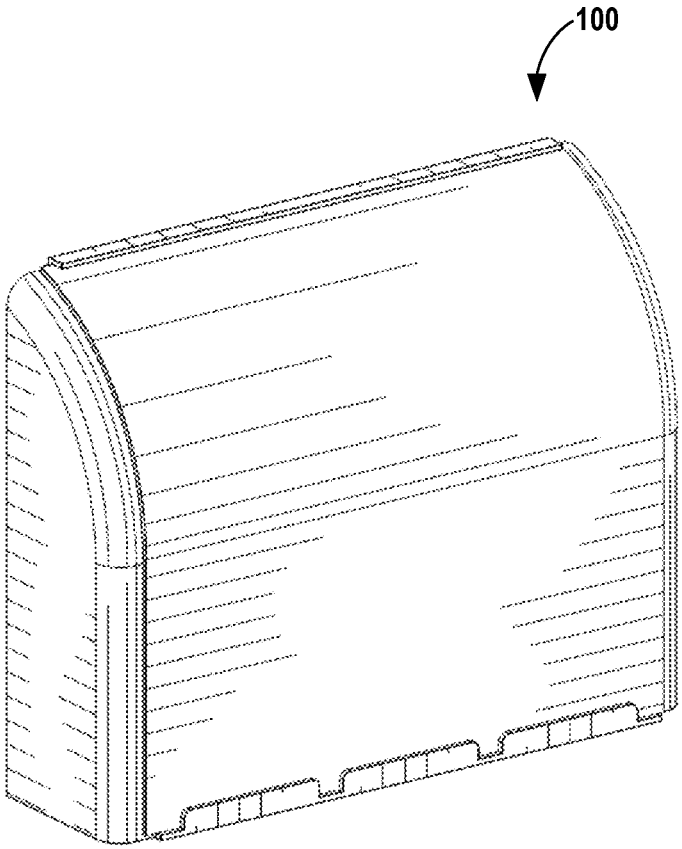
FIG. 1 is a front perspective view of a first embodiment of a magnetic air vent deflector in a closed configuration.
Figure 2:
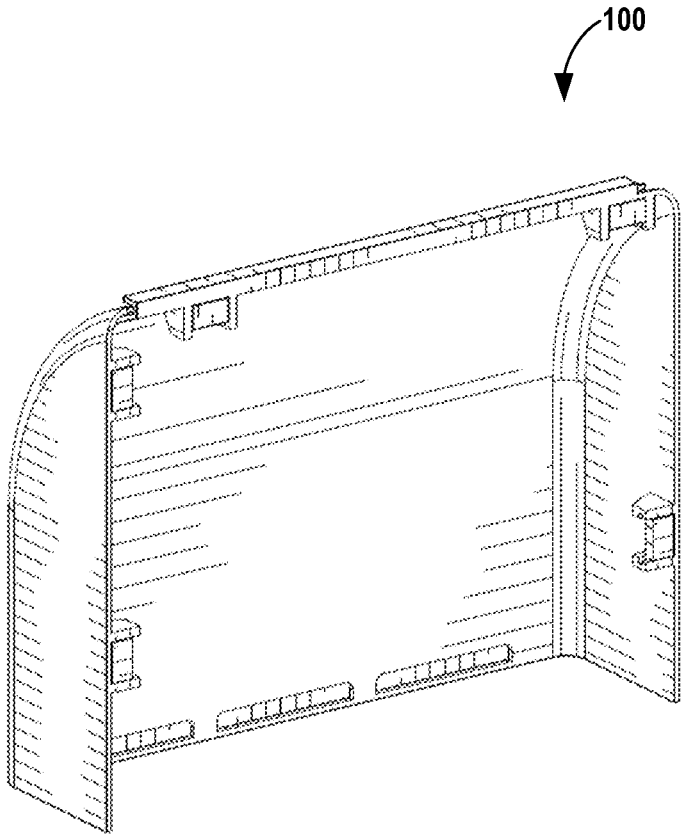
FIG. 2 is a back perspective view of FIG. 1.
Figure 3:
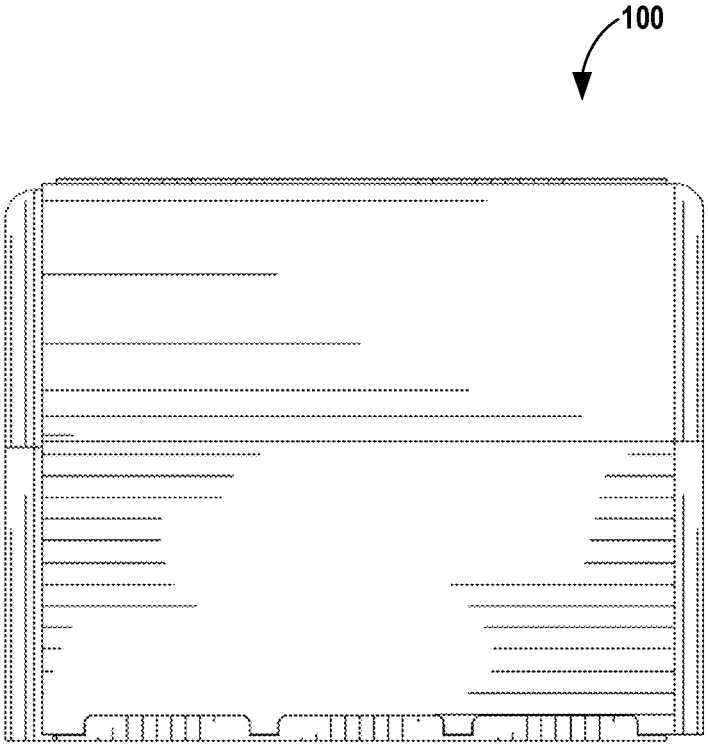
FIG. 3 is a front elevational view of FIG. 1.
Figure 4:
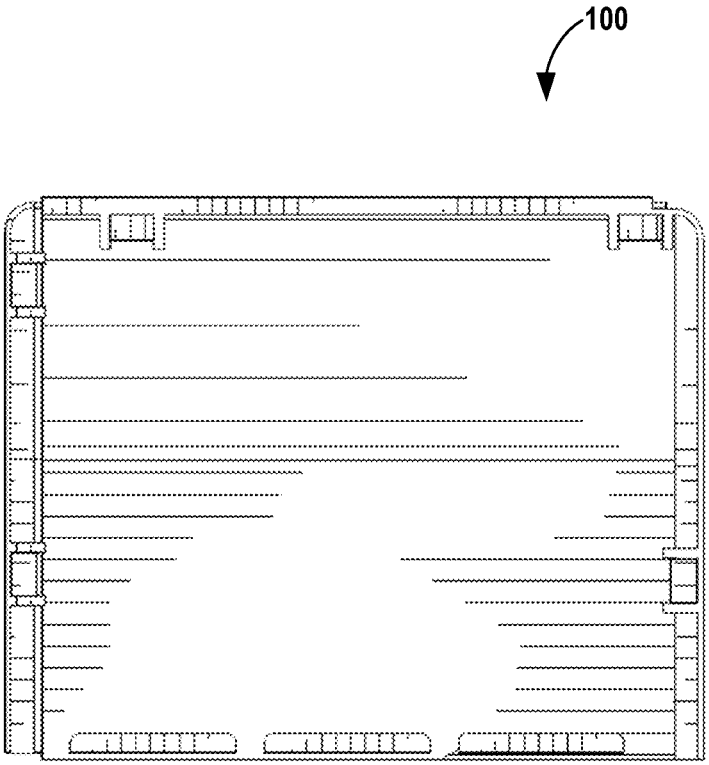
FIG. 4 is a back elevational view of FIG. 1.
Figure 5:
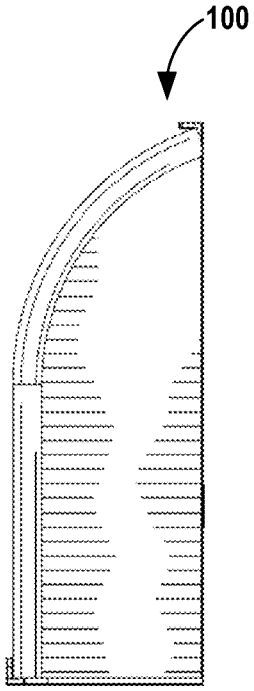
FIG. 5 is a first side elevational view of FIG. 1.
Figure 6:
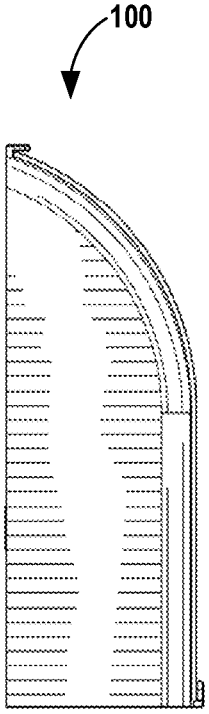
FIG. 6 is a second side elevational view of FIG. 1.
Figure 7:
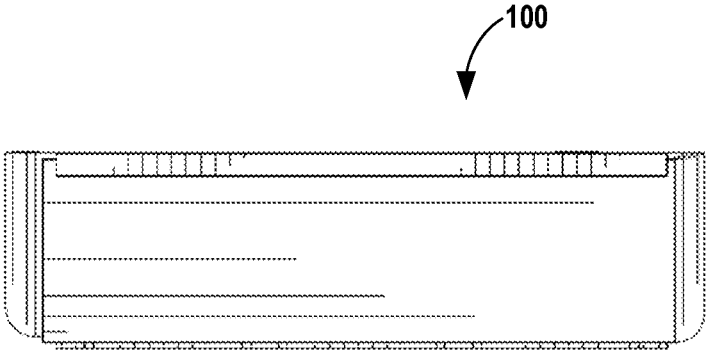
FIG. 7 is a top plan view of FIG. 1.
Figure 8:
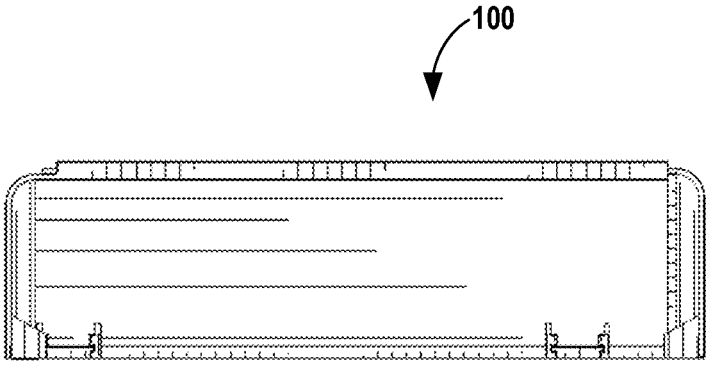
FIG. 8 is a bottom plan view of FIG. 1.
Figure 9:
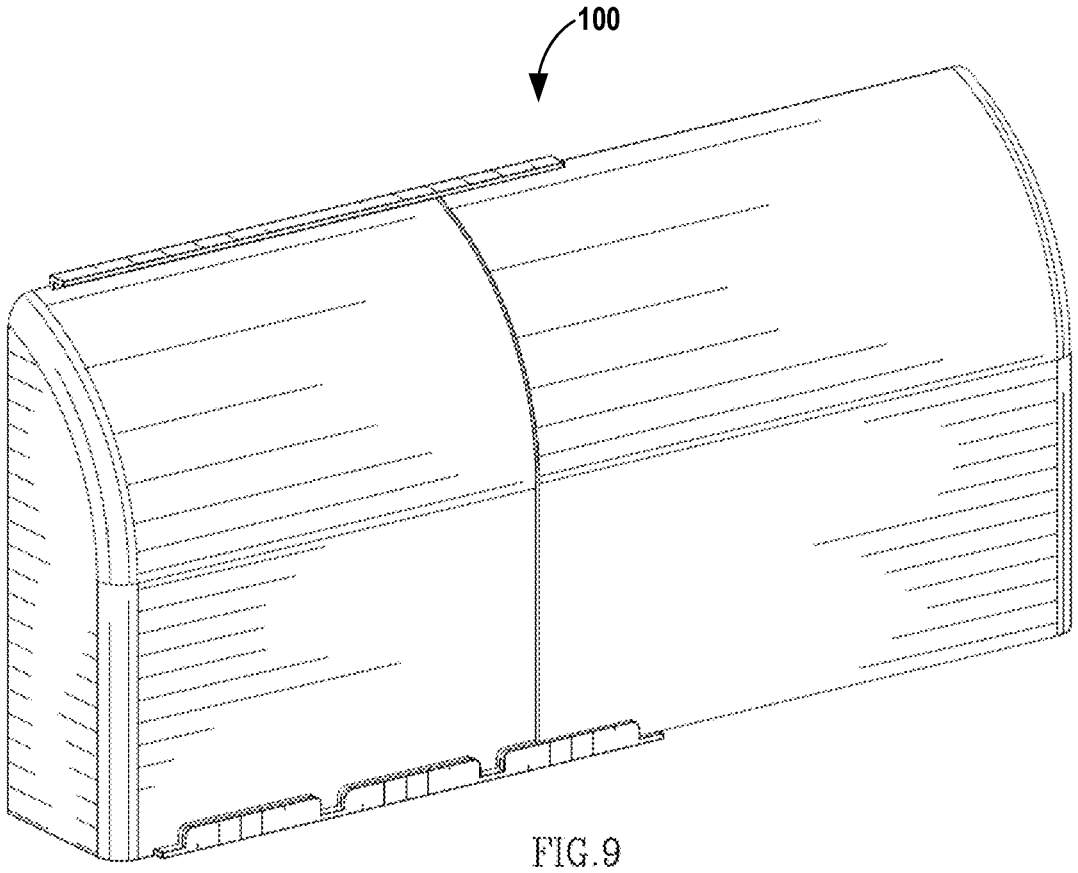
FIG. 9 is a front perspective view of the first embodiment in an open configuration.
Figure 10:
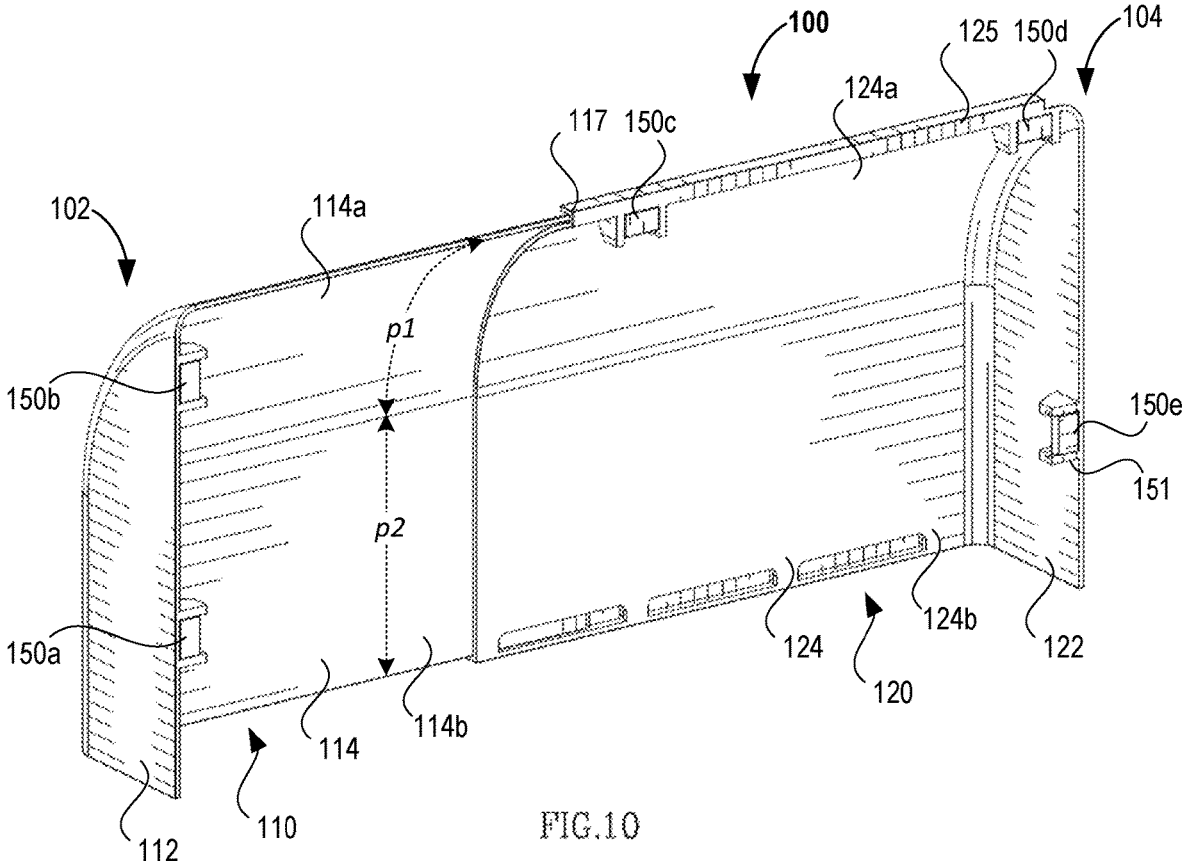
FIG. 10 is a back perspective view of the first embodiment in the open configuration.
Figure 11:
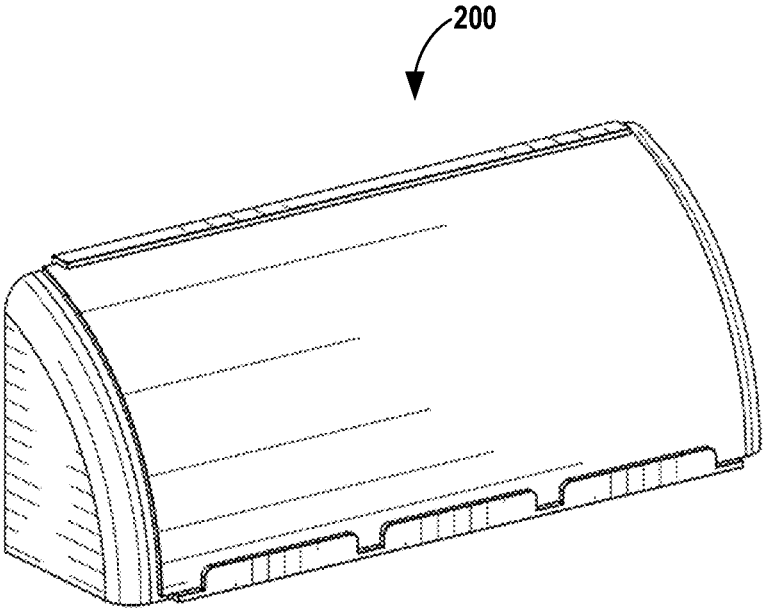
FIG. 11 is a front perspective view of a second embodiment in a closed configuration.
Figure 12:
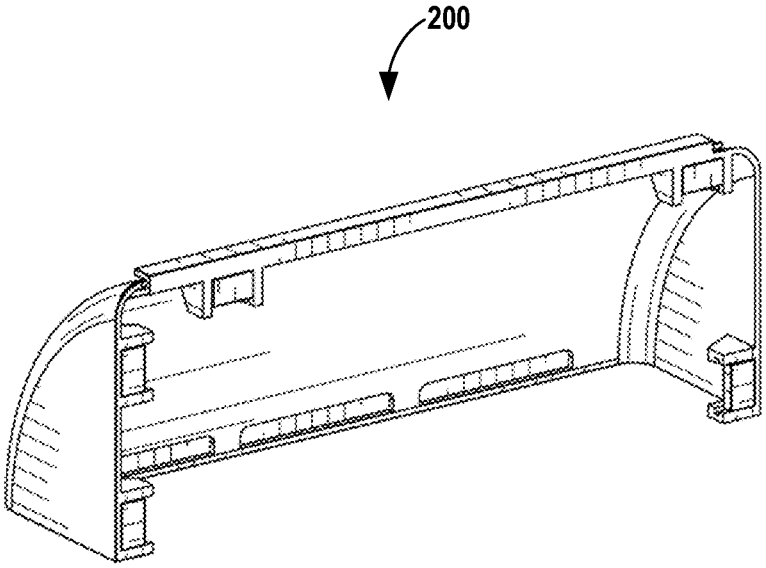
FIG. 12 is a back perspective view of FIG. 11.
Figure 13:
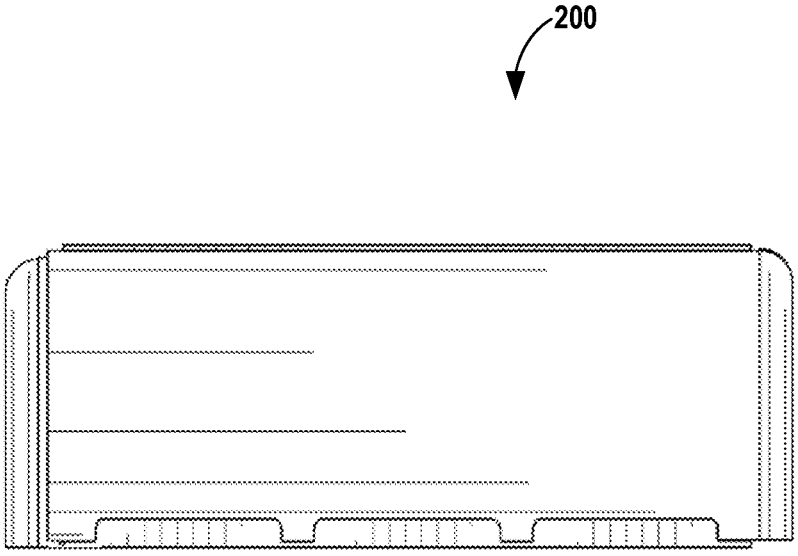
FIG. 13 is a front elevational view of FIG. 11.
Figure 14:
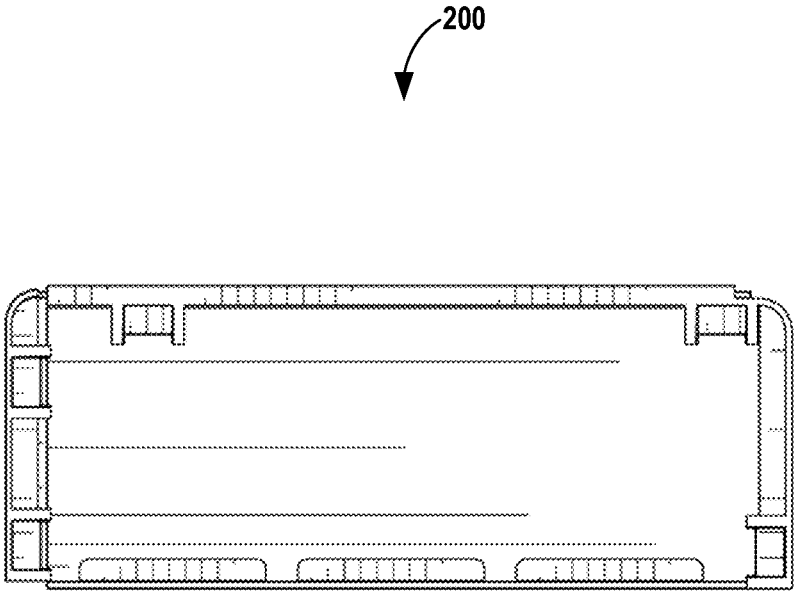
FIG. 14 is a back elevational view of FIG. 11.
Figure 15:
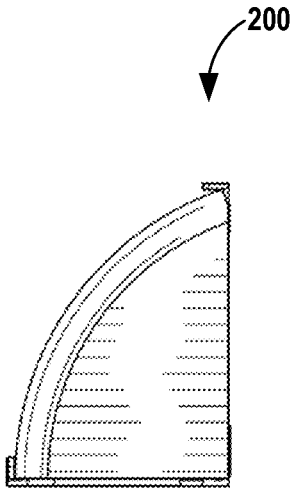
FIG. 15 is a first side elevational view of FIG. 11.
Figure 16:
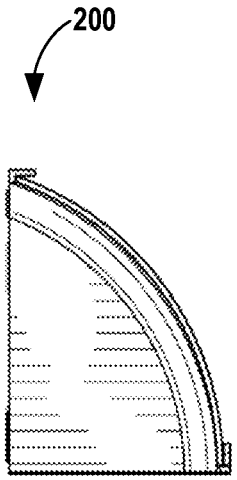
FIG. 16 is a second side elevational view of FIG. 11.
Figure 17:
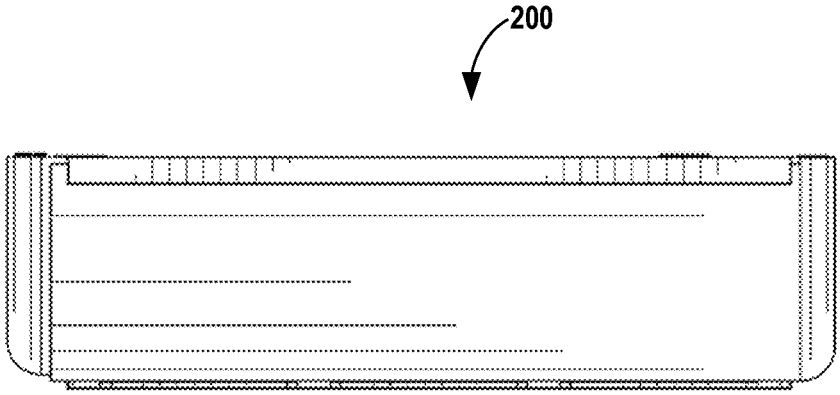
FIG. 17 is a top plan view of FIG. 11.
Figure 18:
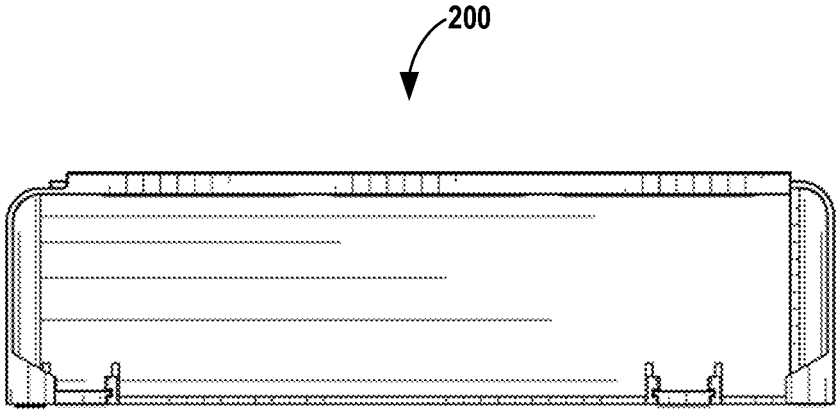
FIG. 18 is a bottom plan view of FIG. 11.
Figure 19:
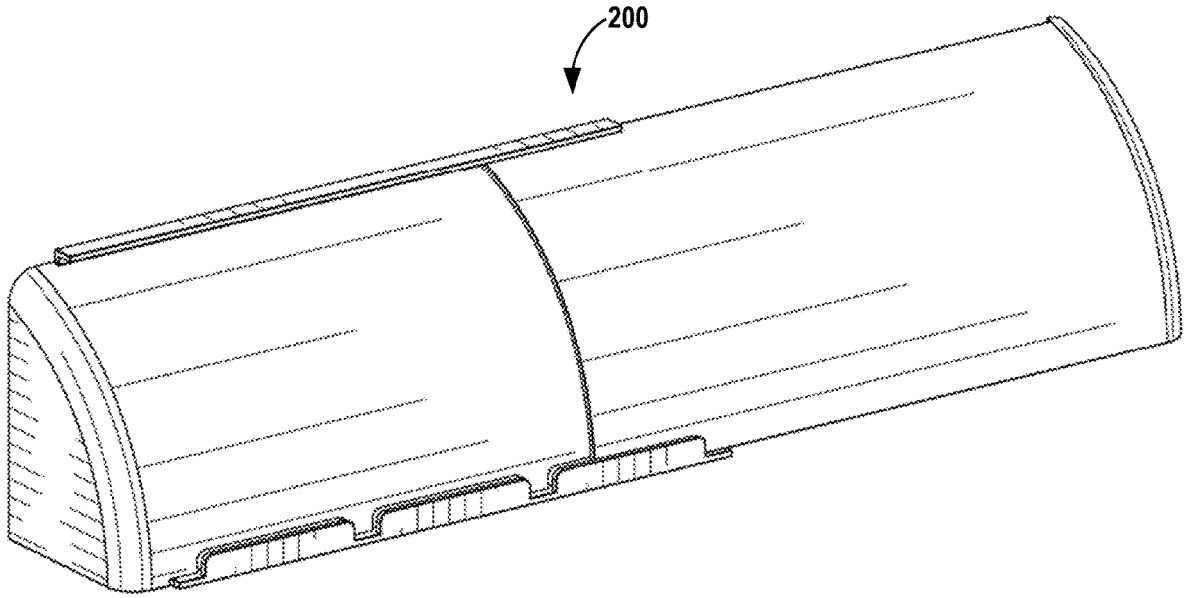
FIG. 19 is a front perspective view of the second embodiment in an open configuration.

FIGS. 1-10 illustrate a first embodiment of an air deflector 100. As best shown in FIG. 10, air deflector 100 may be formed of a rigid material extending from a first end 102 to a second end 104. Air deflector 100 may be generally formed of two portions, including a first portion 110 and a second portion 120. First portion 110 and second portion 120 may be translatable relative to one another in the direction of arrow "A". First portion 110 and second portion 120 may transition from a first state (FIG. 2) to a second state (FIG. 10), the second state having a longer effective length than the first state.

First portion 110 may include an arc-shaped first sidewall 112 and a curved backwall 114. As best seen in FIG. 10, curved backwall 114 may begin at the lower edge of first portion 110 and form a canopied curved surface that transitions from a back surface 114*a* to an upper surface 114*b* of the first portion. In this example, backwall 114 has a first straight portion along path p1, followed by a curved portion along path p2. Similarly, second portion 120 may include an opposing arc-shaped second sidewall 122 and a curved backwall 124. Curved backwall 124 may begin at the lower edge of second portion 120 and form a canopy that transitions from a back surface 124*a* to an upper surface 124*b* of the second portion. As shown, second portion 120 may further include one or more channel(s) 117 sized to receive a portion of the first portion 110.

Air deflector 100 may further include a number of magnets to couple them to a magnetic air vent. Air deflector 100 is shown to include five magnets 150*a*-150*e* disposed within corresponding holders 151. In the example shown, first portion 110 may include a first magnet 150*a* and a second magnet 150*b* disposed on first sidewall 112, the two magnets being spaced from one another. Second portion 120 may include three magnets including two magnets 150*c*,150*d* disposed on a coupling edge 125 of back surface 124*a*, and a third magnet 150*e* disposed on second sidewall 122. Magnets 150*c*,150*d* may be spaced from one another at opposite ends of second portion 120 and magnet 150*e* may disposed on second sidewall 122 at a location that is opposite magnet 150*a* on the opposing first sidewall 112.

Figure 20:
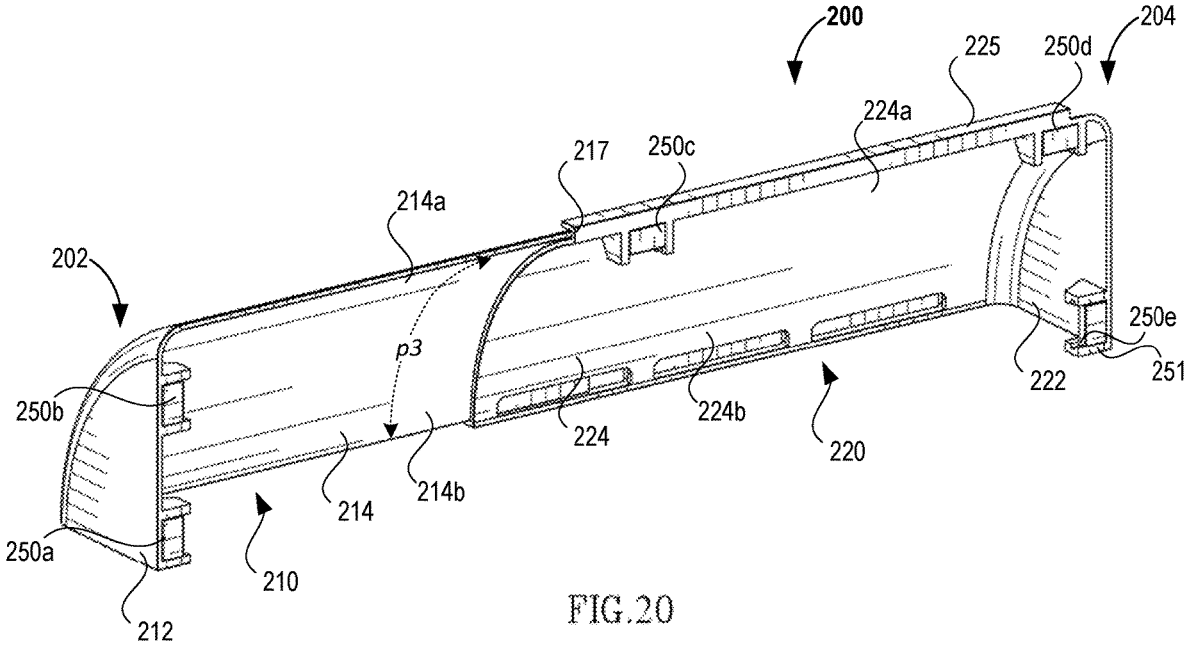
FIG. 20 is a back perspective view of the second embodiment in the open configuration.

FIGS. 11-20 illustrate a second embodiment of an air deflector 200. As best shown in FIG. 20, air deflector 200 may be formed of a rigid material extending from a first end 202 to a second end 204. Air deflector 200 may be generally formed of two portions, including a first portion 210 and a second portion 220. First portion 210 and second portion 220 may be translatable relative to one another in the direction of arrow "A". First portion 210 may include an arc-shaped first sidewall 212 and a curved backwall 214. As best seen in FIG. 20, curved backwall 214 may begin at the lower edge of first portion 210 and form a canopied curved surface that transitions from a back surface 214*a* to an upper surface 214*b* of the first portion. In this example, backwall 214 is curved portion along path p3 and includes no straight portion as found in the first embodiment. Similarly, second portion 220 may include an opposing arc-shaped second sidewall 222 and a curved backwall 224. Curved backwall 224 may begin at the lower edge of second portion 220 and form a canopy that transitions from a back surface 224*a* to an upper surface 224*b* of the second portion. As shown, second portion 220 may further include one or more channel (s) 217 sized to receive a portion of the first portion 210.

Air deflector 200 may further include a number of magnets to couple them to a magnetic air vent. Air deflector 200 is shown to include five magnets 250*a*-250*e* disposed within corresponding holders 251. In the example shown, first portion 210 may include a first magnet 250*a* and a second magnet 250*b* disposed on first sidewall 212, the two magnets being spaced from one another. Second portion 220 may include three magnets including two magnets 250*c*,250*d* disposed on a coupling edge 225 of back surface 224*a*, and a third magnet 250*e* disposed on second sidewall 222. Magnets 250*c*,250*d* may be spaced from one another at opposite ends of second portion 220 and magnet 250*e* may disposed on second sidewall 222 at a location that is opposite magnet 250*a* on the opposing first sidewall 212. As shown, magnets 150*a*,150*e* are disposed at the ends of sidewalls 212,222, respectively.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

The invention claimed is:

1. An air vent deflector extending from a first end to a second end, the air vent deflector comprising:

a first portion including a first sidewall and a first curved backwall;

a second portion including a second sidewall and a second curved backwall, the first portion and the second portion being translatable relative to one another so that an operative distance between the first end and the second end is variable; and a plurality of magnets, including a first magnet, a second magnet, a third magnet, a fourth magnet and a fifth magnet, the first portion including the first magnet and the second magnet disposed on the first sidewall and spaced from one another, the second portion including the third magnet, the fourth magnet and the fifth magnet, the third magnet being disposed on the second curved backwall at a variable position between the first end and the second end, the fifth magnet being disposed on the second sidewall, and the fourth magnet being disposed closer to the fifth magnet than to the third magnet.

2. The air vent deflector of claim 1, wherein the first magnet and the fifth magnet are positioned at ends of the first sidewall and the second sidewall, respectively.

3. The air vent deflector of claim 1, wherein the first portion is arc-shaped and the second portion is arc-shaped.

4. The air vent deflector of claim 1, wherein the third magnet is positioned near an opposite lateral end of a coupling edge of the second curved backwall.

5. The air vent deflector of claim 1, further comprising holders disposed on the first portion and the second portion, the holders being configured and arranged to receive the plurality of magnets.

6. The air vent deflector of claim 5, wherein the holders are integrally formed with the first portion and the second portion.

7. The air vent deflector of claim 1, wherein the second portion includes at least one channel for receiving a portion of the first portion.

8. The air vent deflector of claim 1, wherein the first portion and the second portion can transition from a first state to a second state, the second state having a longer effective length than the first state.

9. The air vent deflector of claim 1, wherein the plurality of magnets includes five magnets in total.

10. An air vent deflector comprising:

a first portion including a first sidewall and a first curved backwall;

a second portion including a second sidewall and a second curved backwall, the first portion and the second portion being translatable relative to one another; and a plurality of magnets disposed on the first portion and the second portion, the first portion including a first group of at least one magnet disposed on the first sidewall, a second group of at least one magnet disposed on the second sidewall, and a third group of at least one magnet disposed on a coupling edge of the second curved backwall of the second portion, a number of magnets on the first portion being unequal to a number of magnets on the second portion;

wherein the second group of at least one magnet includes an odd number of magnets.

11. The air vent deflector of claim 10, wherein the first group of at least one magnet includes two magnets spaced apart from one another.

12. The air vent deflector of claim 11, wherein the first group of at least one magnet includes an even number of magnets.

13. The air vent deflector of claim 11, wherein the second group of at least one magnet includes a single magnet.

14. The air vent deflector of claim 11, wherein the third group of at least one magnet includes two magnets spaced from one another.

15. The air vent deflector of claim 11, wherein the first portion is arc-shaped and the second portion is arc-shaped.

16. The air vent deflector of claim 10, further comprising holders disposed on the first portion and the second portion, the holders being configured and arranged to receive the plurality of magnets.

17. An air vent deflector extending from a first end to a second end, the air vent deflector comprising:

a first portion including a first sidewall and a first curved backwall;

a second portion including a second sidewall and a second curved backwall, the first portion and the second portion being translatable relative to one another to transition between a first state and a second state so that an operative distance between the first end and the second end is variable, the second state having a longer effective length than the first state; and a plurality of magnets disposed on the first portion and the second portion and arranged in groupings of at least one magnet disposed on a segment having opposing edges, the segment being selected from the first sidewall, the second sidewall, the first curved backwall and the second curved backwall;

wherein each of the plurality of magnets is positioned offset from a midpoint between the opposing edges of a respective segment such that it is closer to a first one of the opposing edges than to a second one of the opposing edges.

18. The air vent deflector of claim 17, wherein a first of the groupings has fewer magnets than a second of the groupings.

19. The air vent deflector of claim 17, wherein a third of the groupings includes two magnets.

* * * * *